United States Patent [19]

Deguchi

[11] 3,989,089

[45] Nov. 2, 1976

[54] HOLLOW CORE MOLDING DEVICE FOR USE IN SHELL MOLD

[75] Inventor: Nobuaki Deguchi, Kuwana, Japan

[73] Assignee: Hitachi Metals, Ltd., Japan

[22] Filed: Sept. 16, 1974

[21] Appl. No.: 506,343

[30] Foreign Application Priority Data

| | | |
|---|---|---|
| Sept. 21, 1973 | Japan | 48-106015 |
| Sept. 21, 1973 | Japan | 48-106016 |
| Oct. 17, 1973 | Japan | 48-119886[U] |

[52] U.S. Cl. ..... 164/201; 164/22

[51] Int. Cl.[2] ..... B22C 15/22

[58] Field of Search ..... 164/165, 361, 410, 200, 164/201, 202, 253, 119, 160, 304, 315, 323, 337, 410, 412, 61, 63, 198, 253, 280, 159, 169; 425/130

[56] References Cited

UNITED STATES PATENTS

| | | | |
|---|---|---|---|
| 2,512,871 | 6/1950 | Ostermann | 164/202 |
| 2,607,967 | 8/1952 | Springer | 164/200 |
| 2,825,107 | 3/1958 | Schueler | 164/61 X |
| 2,933,785 | 4/1960 | Hansberg | 164/160 |
| 3,528,481 | 9/1970 | Lund | 164/200 X |
| 3,581,948 | 6/1971 | Detalle | 164/337 X |
| 3,761,218 | 9/1973 | Portalier | 164/306 X |
| 3,888,612 | 6/1975 | Schrewe | 425/130 |

*Primary Examiner*—Francis S. Husar
*Assistant Examiner*—John S. Brown
*Attorney, Agent, or Firm*—Craig & Antonelli

[57] ABSTRACT

A hollow core molding device for use in a shell mold is disclosed, which device uses for molding a hollow core a permanent mold which is parted into a top part and a bottom part in the horizontal direction. This molding device includes a sand container having some sand injecting pipes for supplying shell sand into the permanent mold; a valve mechanism adapted to be communicated with an external vacuum means; and a nozzle means, through which are injected shell sand into cavities in the permanent mold by being fitted therein; the aforesaid valve mechanism being interposed between the sand container and the nozzle means; whereby for injection of shell sand into the permanent mold, the sand container is communicated with the permanent mold, while after injection of shell sand, the permanent mold is communicated with the external vacuum means to discharge under suction unhardened shell sand within the hardened shell of a core within a desired short period of time.

5 Claims, 9 Drawing Figures

HOLLOW CORE MOLDING DEVICE FOR USE IN SHELL MOLD

This invention relates to a hollow core molding device for use in a shell mold, in which resin sand for a shell mold is injected with compressed air into a preheated permanent mold for molding a core to thereby cause the shell sand to adhere to the inner surface of the permanent mold to a given thickness, thus forming a core having a hardened shell which is in contact with the inner surface of the permanent mold, after which unhardened shell sand contained in the hardened shell of the core is discharged under suction out of the permanent mold.

Hitherto, for preparing a hollow core, it has been a common practice to use a vertical core permanent mold, wherein shell mold resin sand is injected through a top hole of the permanent mold therein, the sand is baked, and then the permanent mold is turned upside down to thereby discharge un-hardened shell sand outside.

However, such an attempt is plagued with disadvantages enumerated as follows:

1. Since the permanent mold has a vertical parting plane and shell sand is injected through a hole provided in the top portion of the mold, the cavity for a core within the permanent mold should have at least one opening on the aforesaid parting plane. This imposes limitations on the configuration of a core to be molded.

2. In association with the above paragraph (1), the number of cores to be molded in a set of permanent mold at a time cannot be increased to a desired level.

3. Since the unhardened shell sand within the shell of a core is discharged by gravity, i.e., by turning the permanent mold upside down, discharge of shell sand may not be completed within a short period of time. One of attempts to overcome this shortcoming is that vibrating means is attached to a permanent mold to give vibration thereto. However, this is apparently detrimental to the quality of a core, leading to cracking or other defects.

4. For removing a core from a permanent mold, there has been proposed an attempt, wherein there is provided a hole extending from the back of a permanent mold therethrough in the direction at right angle to the parting plane of the permanent mold, and then there is disposed a knock-pin therein for knocking the core to the exterior. This then brings about another difficulty in turning over the permanent mold together with the core knock-pin in their assembled condition. Thus, there results complicated constructions of a core molding device and a permanent mold.

To improve the aforesaid prior art core molding device for use in a shell mold, there has been proposed a device, in which or unhardened shell sand within the hardened shell of a core in a permanent mold is instantaneously discharged under suction of air of a given quality, after the injection of shell sand into a permanent mold. However, this dictates the provision of an opening in the bottom surface of a permanent mold for discharging shell sand outside. In addition, this does not permit the continuous discharge of the unhardened shell sand due to the application of suction, so that limitations are also imposed on the shape and size of a core.

It is accordingly an object of the present invention to provide a hollow core molding device for use in a shell mold, which avoids the shortcomings experienced with the prior art device of this type, while providing a hollow core within a desired short period of time, and which permits the simultaneous molding of cores in a great amount by using a set of permanent mold having a horizontal parting plane.

It is another object of the present invention to provide a hollow core molding device for use in a shell mold, which device is compact in size and dispenses with complicated operations and controls associated therewith.

It is a further object of the present invention to provide a hollow core molding device for use in a shell mold, which eliminates the need of rapid application of pressure to shell sand with compressed air at the start of the core molding operation, as well as the rapid exhaust of air for discharging excessive unhardened shell sand within the hardened shell of a core, after the injection (the blowing) of shell sand into a permanent mold.

These and other objects and features of the present invention is readily attained in a hollow core molding device for use in a shell mold, which device comprises: a sand container having a sand feeding pipe for supplying shell sand into a permanent mold for molding a core; a valve mechanism adapted to be communicated with an external vacuum means; and a nozzle means, through which is injected shell sand into the cavity in the permanent mold by being fitted therein; the aforesaid valve mechanism being interposed between the said container and the nozzle means; whereby for injection of shell sand into the permanent mold, the sand container is communicated with the permanent mold, while after injection of shell sand the permanent mold is communicated with the external vacuum means to discharge under suction the un-hardened shell sand within the hardened shell of a core within a desired short period of time.

Description will now be given in more detail by way of examples with reference to the accompanying drawings.

Figure 1:
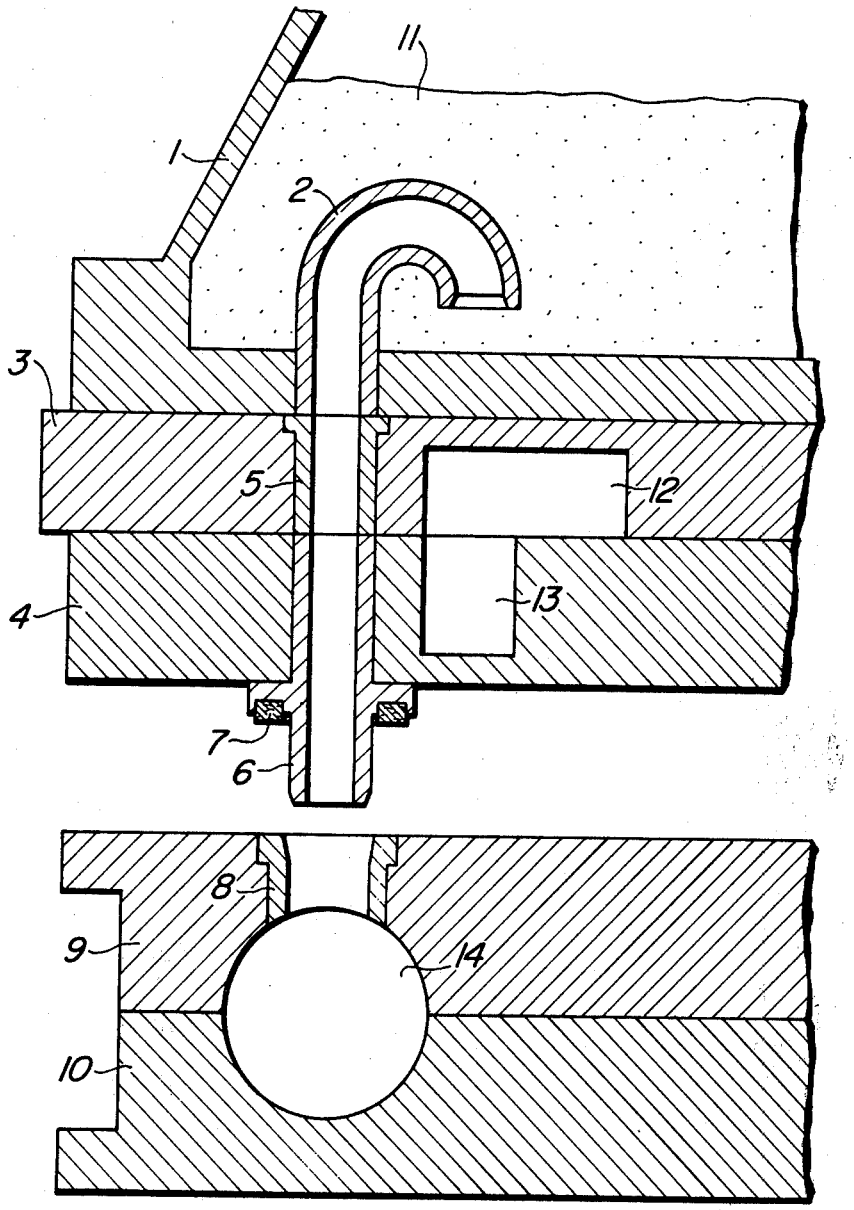
FIG. 1 is a vertical cross-sectional view of the essential parts of a shell sand injecting device and a core permanent mold, showing the first embodiment of the present invention.
Figure 2:
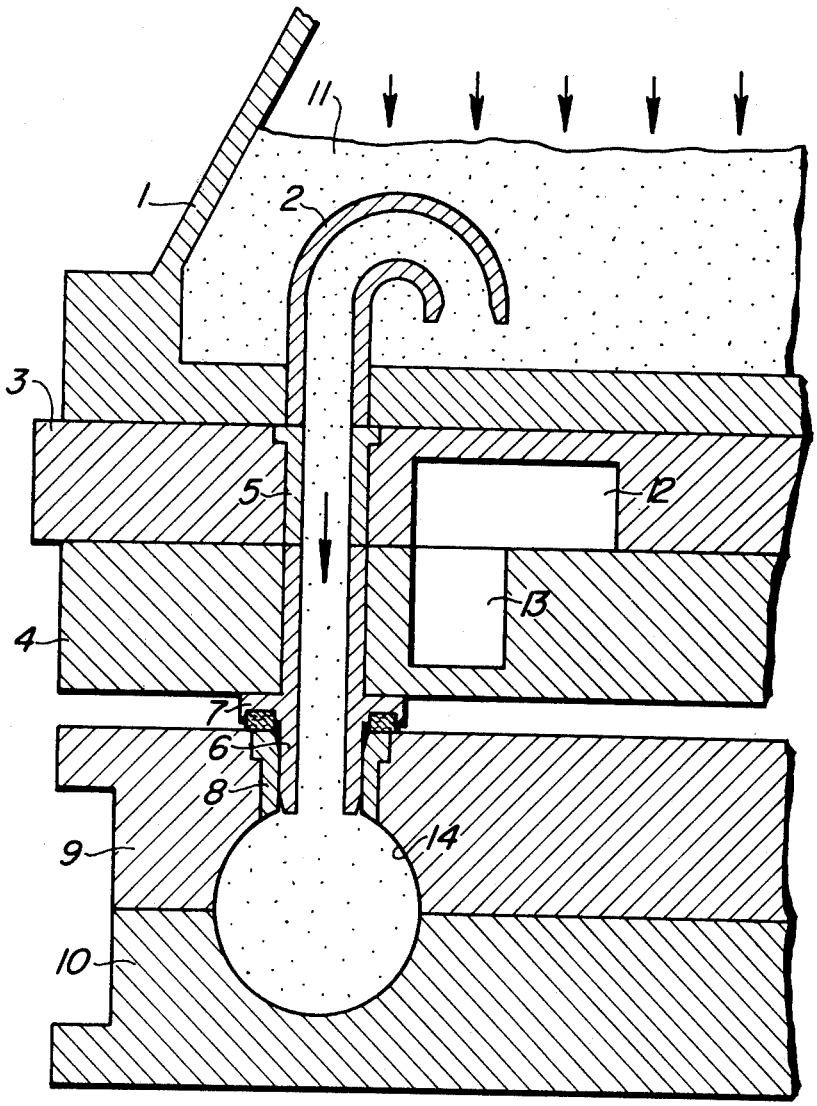
FIG. 2 is a vertical cross-sectonal view of the essential parts of a shell sand injecting device and a core permanent mold at the time of injection of shell sand as shown in FIG. 1.
Figure 3:
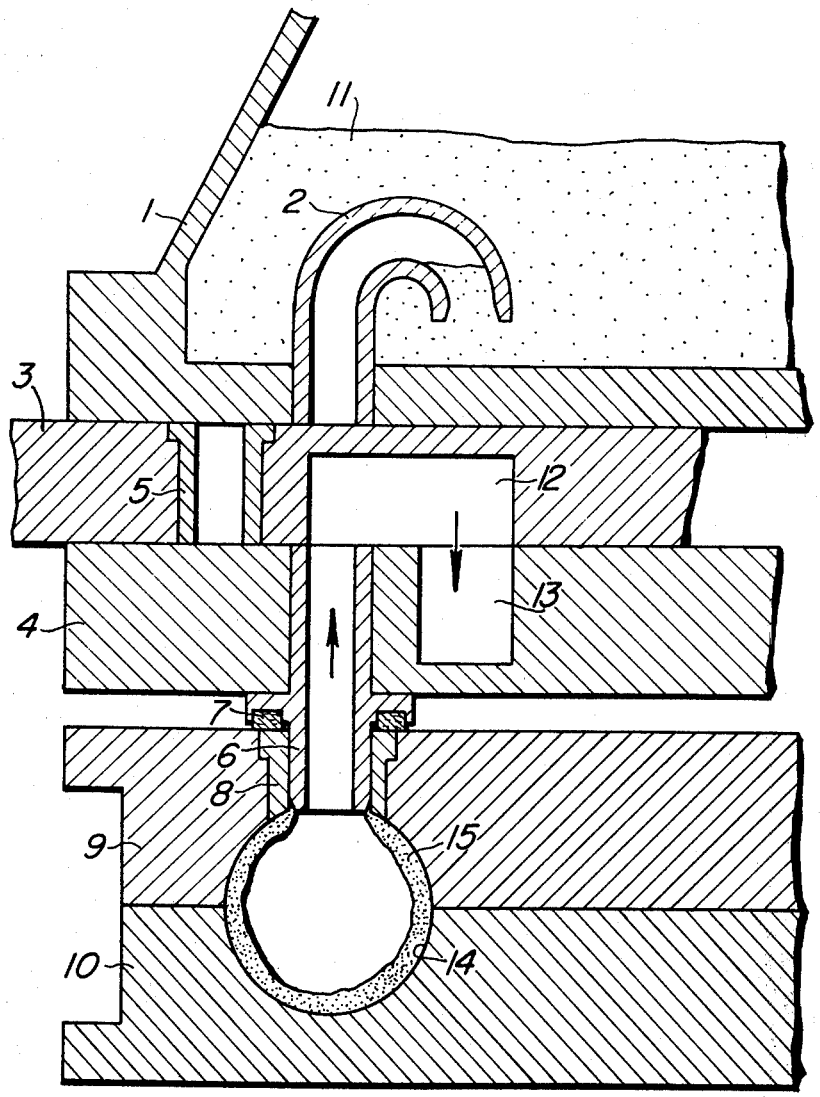
FIG. 3 is a vertical cross-sectional view of the essential parts of the shell sand injecting device and the core permanent mold at the time of discharging excessive unhardened shell sand under suction, as shown in FIG. 1.

FIGS. 1 through 3 show the first embodiment of the present invention. FIG. 1 shows the condition of shell sand prior to injection. Interposed between a sand injecting pipe 2 attached to a sand container 1 and a sand injecting nozzle 6 attached to a fixed suction box 4 having a suction chamber 13 therein are a sand injecting pipe 5 and a movable suction box 3 which are slidingly movable, the sand injection pipe 5 being adapted to communicate the sand injecting pipe 2 with the sand injecting nozzle 6.

The core permanent mold is split in the horizontal direction into a top part 9 and a bottom part 10, and defines a cavity 14 therein when put together. A bushing 8 is fixedly fitted in a hole provided in the top part 9, while a sand injecting nozzle 6 is fitted in the bushing 8. Fitted on the nozzle 6 is a seal 7 which prevents air leak from the fitting portion of the nozzle 6.

FIG. 2 shows the condition of a core permanent mold, i.e., top and bottom parts 9, 10 at the time of injection of sand. The core molds 9, 10 are raised by suitable means (not shown), until the top surface of the top part 9 abuts the seal 7 of the sand injecting nozzle 6, after which the core mold is held thereat, with an upward force being applied thereto. Then, sand injecting pipe 2 is brought into communication with the sand injecting nozzle 6 due to the movement of the movable suction box, and then compressed air is applied on the surface of a shell sand 11 in the sand container 1, so that the shell sand 11 is injected into the cavity 14 defined in the preheated core molds 9, 10 and then the shell sand contiguous to the inner surface of the core permanenet molds 9, 10 begin to be hardened due to the heat therefrom.

FIG. 3 shows the condition where unhardened, excessive shell sand is being discharged under suction. After the lapse of time required for hardening the shell sand in cavity 14 to a required thickness, the movable suction box 3 is slidingly moved so as to bring the sand injecting nozzle 6 in communication with the suction chamber 12 and suction chamber 13. Subsequently, the unhardened shell sand inside the hardened shell of a core 15 is sucked by means of a vacuum means located externally, thereby obtaining a hollow core 15.

According to the aforesaid first embodiment, the movable suction box 3, which is provided with the sand injecting pipe 5 and suction chamber 12, is interposed between the sand container 1 and the fixed suction box, which is provided with a nozzle 6 for injecting shell sand into the cavity 14 being fitted in the core permanent mold and with the suction chamber 13 communicating with an external vacuum means, thereby constituting a valve mechanism for discharging under suction the unhardened shell sand within the hardened shell of the core 15.

Figure 4:
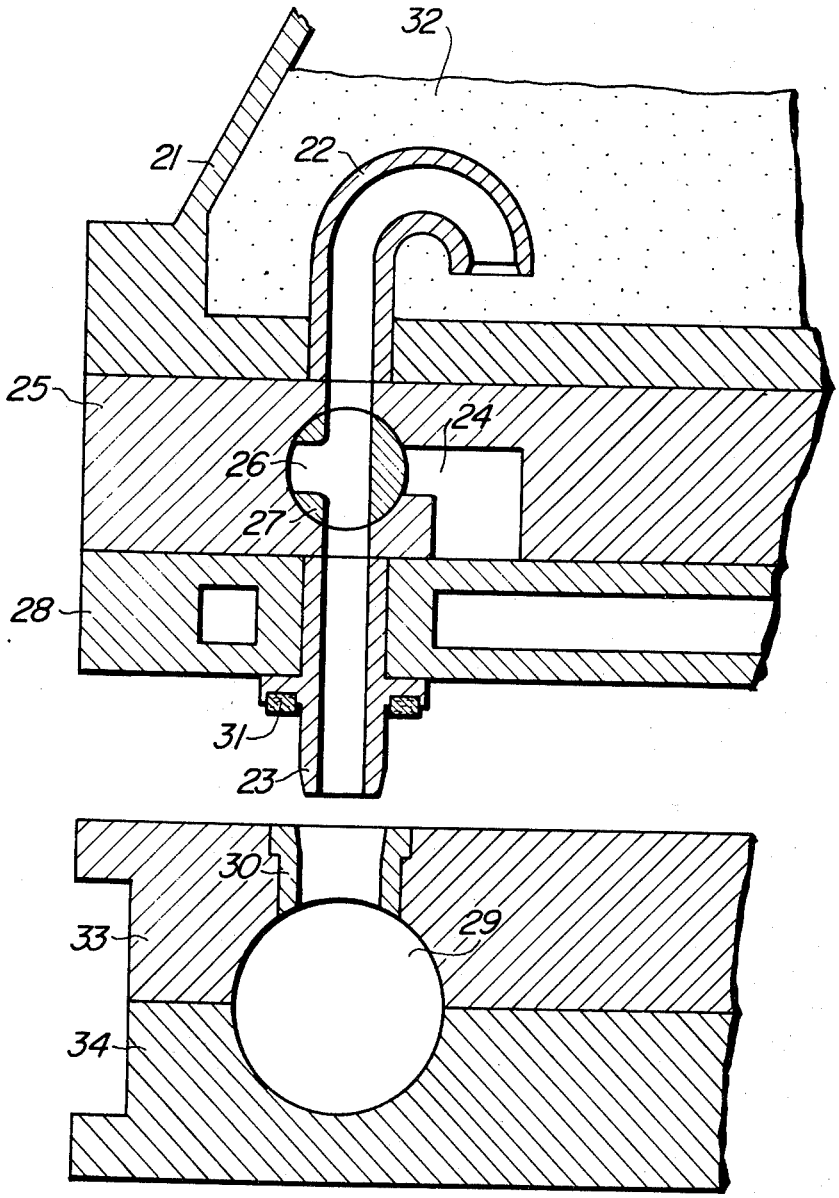
FIG. 4 is a vertical cross-sectional view of the essential parts of the shell sand injecting device and core permanent mold, prior to the injection of shell sand, showing the second embodiment of the present invention.
Figure 5:
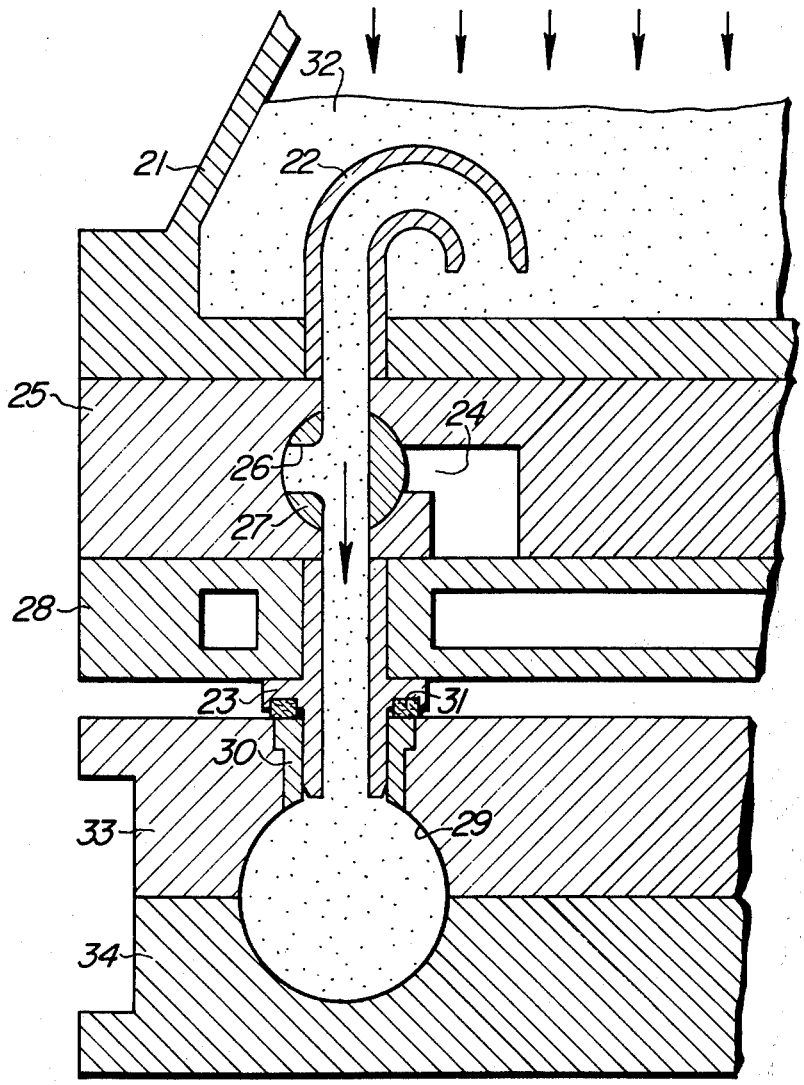
FIG. 5 is a vertical cross-sectional view of the essential parts of the shell sand injection device and core permanent mold, at the time of injection of shell sand, as shown in FIG. 4.
Figure 6:
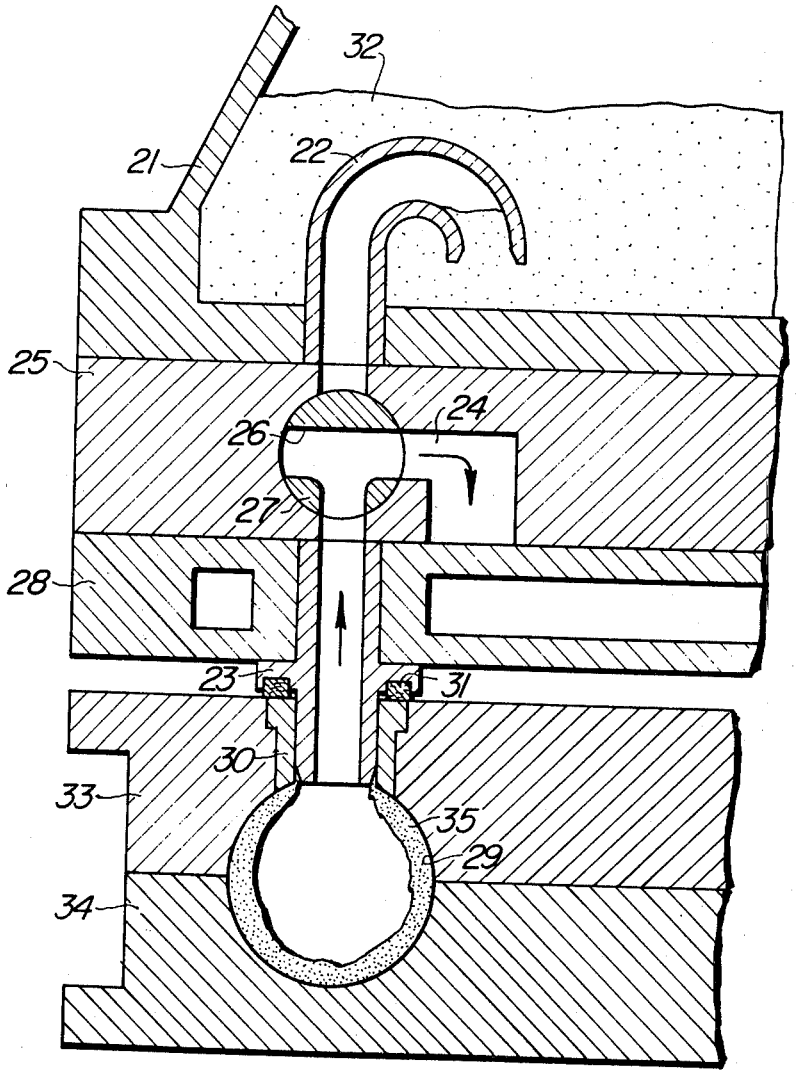
FIG. 6 is a vertical cross-sectional view of the essential parts of the injection device and permanent mold, in which excessive unhardened shell sand is being discharged under suction from within a hardened shell of a core.

Turning now to the second embodiment of the invention, FIGS. 4 through 6 show the second embodiment, in which a sand injecting pipe 22 is fitted through the bottom portion of a sand container 21, with the U-shaped upper part of the pipe 22 is located within the container 21. In addition, a fixed suction box 25 having a suction chamber 24 communicating with an external vacuum means (not shown) is interposed between the lower end of the sand injecting pipe 22 and the upper end of the sand injecting nozzle 23 which is to be fitted in the top part 33 of the core permanent mold. Still furthermore, a rotary switching valve 27 of a column form is fitted within the fixed suction box 25, the valve 27 having a T-shaped through-hole 26 which has three perpendicularly intersecting branch holes in the radial direction, thus constituting a valve mechanism for discharging the unhardened shell sand within the hardened shell of a core. With this arrangement, the same injecting pipe 22 may be communicated with or blocked from the sand injecting nozzle 23, while the sand injecting nozzle 23 may be communicated with or blocked from the suction chamber 24, respectively.

Meanwhile, shown at 28 is a water cooling box, in which is fitted the injecting nozzle 23, at 29 a cavity for core which is defined within a set of core molds, or top part and bottom part, 33, 34, respectively, at 30 a bushing fitted in the top part 33 and adapted for use in fitting the injecting nozzle 23 in the top part 33 therein, at 31 a seal fitted around the injecting nozzle for maintaining air tightness between the injecting nozzle 23 and the top part 33 of the core mold, when the top part 33 and bottom part 34 of the core mold are raised so as to connect with the nozzle 23, at 32 shell sand and at 35 a hollow core.

For molding a hollow core in the aforesaid second embodiment of the invention, the rotary valve 27 is rotated so as to communicate sand injecting pipe 22 with sand injecting nozzle 23, while blocking the communication with the suction chamber 24 (FIG. 4). Then, the core permanent molds 33, 34 (are) raised by means of a suitable lifting means into engagement with the device of the present invention. Then, as shown in FIG. 5, compressed air is introduced into the sand container 21 to act on the top surface of shell sand 32 therein, so that the shell sand 32 is injected into the cavity 29 in a desired amount. Thus, the shell sand adheres to the inner surface of cavity 29 in the core permanent mold, which has been preheated, to form a core 35 having a hardened shell of a desired thickness. At this time, the rotary switching valve 27 is rotated to block the sand injecting nozzle 23 from the sand injecting pipe 22, while communicating with the suction chamber 24 in the fixed suction box 25. (FIG. 6) Thereafter, the fixed suction box 25 is connected to an external vacuum source (not shown) to discharge excessive unhardened shell sand which is not contiguous to the inner surface of the mold, for a desired time period at a given vacuum level, thus completing the molding of hollow core 35.

Experiments prove that when a blower presenting an air flow rate of 16 $m^3$/min and negative pressure of 450 mmHg is used as a vacuum source, excessive shell sand of 1 kg within the hardened shell of the core may be dischared under suction for 1 to 2 seconds. This corresponds air of a suction rate of about 250 liter/second when resorted to the conventional device, in which a given quantity of air is sucked. This means that the size of a conventional molding device especially the size of its vacuum device for use in a shell mold should be unreasonably increased.

Figure 7:
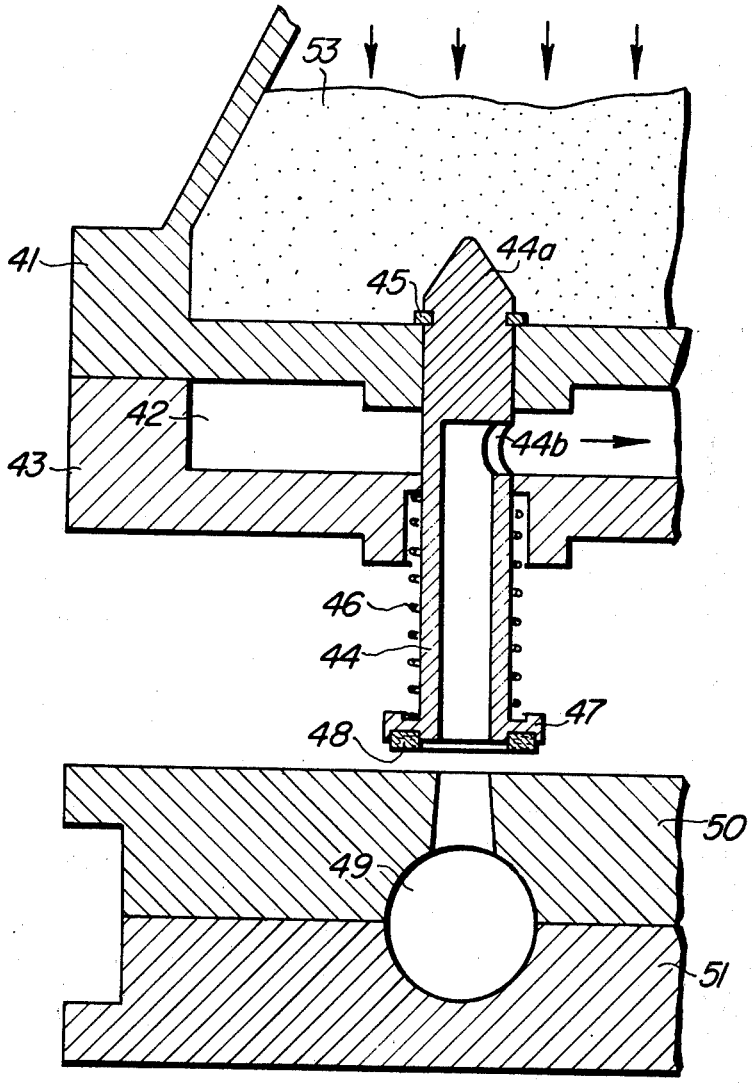
FIG. 7 is a vertical cross-sectional view of the essential parts of the shell sand injecting device and shell sand permanent mold, prior to injection of shell sand, showing the third embodiment of the present invention.
Figure 8:
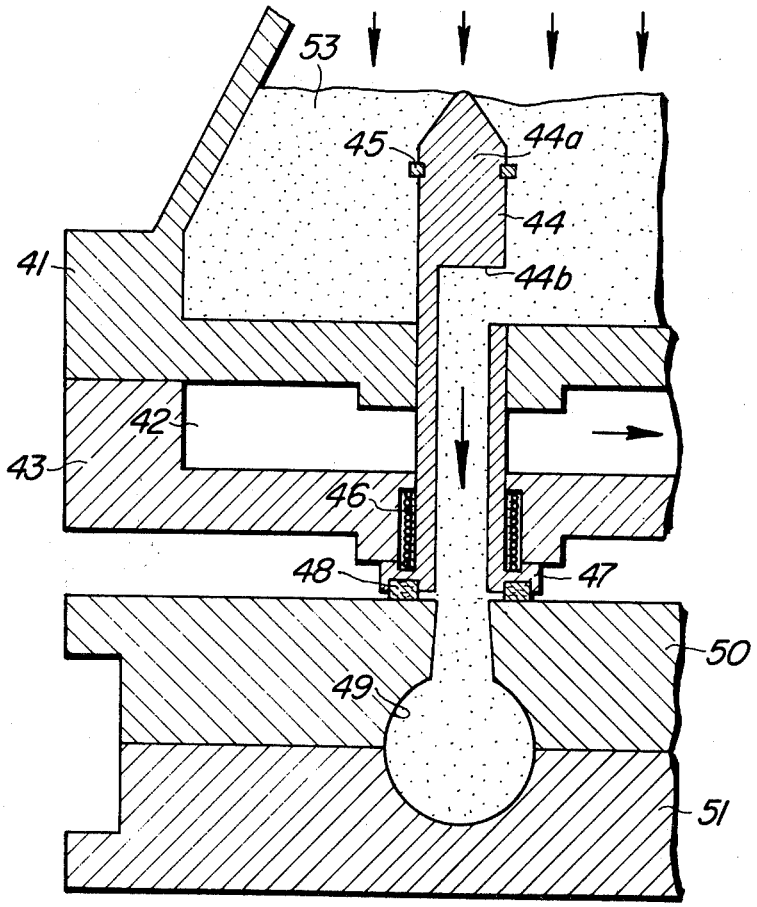
FIG. 8 is a vertical cross-sectional view of the essential parts of the injection device and permanent mold as shown in FIG. 7.
Figure 9:
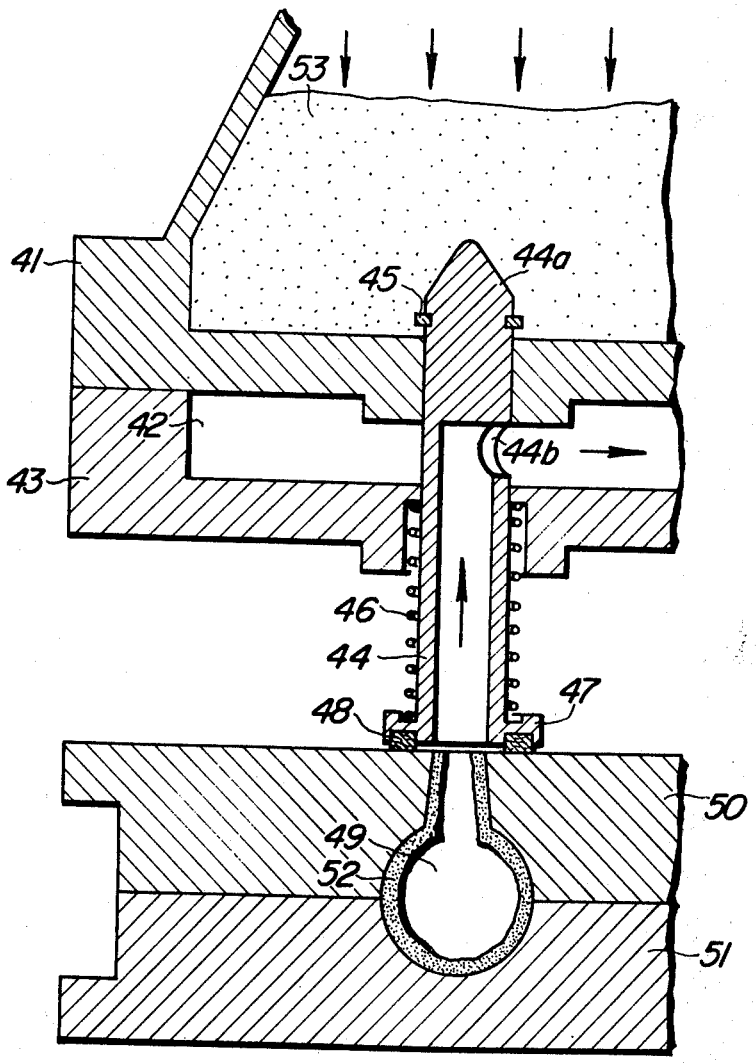
FIG. 9 is a vertical cross-sectional view of the essential parts of the injecting device and permanent mold, showing excessive unhardened shell sand being discharged from within a hardened shell of a core.

Now, description will be given of the third embodiment of the invention, which is shown in FIGS. 7 to 9. According to this embodiment, a fixed suction box 43 having a suction chamber 42 communicated with an external vacuum source (not shown) is placed in close contact with a sand container containing shell sand 53 therein. In addition, a sand injecting pipe 44 which has closed peaked end 44*a* and a passage 44*b* contiguous to the closed peaked end but extending through the body of the pipe 44 and open on one side, is fitted through the sand container 41 and the fixed suction box 43, with the closed peaked end 44*a* being located within the sand container 41. Furthermore a retaining ring 45 is fitted around the closed, peaked end 44*a*, and a flange 47 is formed around the lower end of the pipe 44, with a compression spring 46 being confined between the flange 47 and the fixed suction box 43, so that the spring 46 may act so as to urge the end of the pipe 44 away from the suction box 43. In addition, a core permanent mold or top part and bottom part 50, 51 are disposed on the side of the open end of sand injecting pipe 44. The core permanent mold is so designed as to urge the open end of the sand injecting pipe 44, thereby permitting injection or discharging of sand in or from the molded core. More particularly, when the core is to be molded as shown in FIG. 89, the passage 44*b* is brought to its open position within the sand container 41 to allow the injection of shell sand 53 into a cavity 49 in the core permanent mold 50, 51. On the other hand, after molding of the core 52, the passage 44*b* is brought into communication with the suction chamber 42 in the fixed suction box 43 to thereby discharge the unhardened excessive sand within the hardened shell of the core 52 therefrom.

As is clear from the foregoing, the sand injecting pipe 44 and the fixed suction box 43 constitute a valve mechanism. More specifically, when the shell sand is injected, with the passage 44*b* in the sand injecting pipe 44 being open within the sand container 41, the communication of core permanent mold 50, 51 with suction chamber 42 in the fixed suction box 43 is interrupted (FIG. 8). On the other hand, when the excessive shell sand within the hardened shell of the core 52 is discharged under suction, with the passage 44*b* in the sand injecting pipe 44 being in communication with the suction chamber 42, the communication of the sand container 41 with the core permanent mold 50, 51 is interrupted by means of the closed, peaked end 44*b* of the sand injecting pipe 44 (FIG. 9).

As shown in FIGS. 7 to 9, there is provided at 48 a seal member for maintaining air-tightess between the flange 47 of sand injecting pipe 44 and the top surface of top part 50 of core permanent mold, in case the core permanent mold 50, 51 is brought into abutting relation to the device according to the present invention.

The working of the present invention as described above provides the following advantages. (1) Since the permanent mold is split into a top part and a bottom part in the horizontal direction, shell sand can be injected through any portion of a back plane (upper portion) of the permanent mold parallel to the parting plane. As the result the configuration of a core to be molded is not limited. (2) In the same reason a great amount cores can be molded simultaneously by using a set of permanent mold. (3) Since the unhardened shell sand may be discharged under suction by the external vacuum means within a desired short period of time, hollow cores can be molded without cracking or other defects. (4) Since it is not necessary that the permanent mold is turned upside down to discharge shell sand outside, mechanical means can be simplified. (5) In the prior art, the shell sand remain in a sand injecting nozzle dropped and fixed on a surface of the permanenet mold when the permanent mold is separated from the injecting means after the shell sand are injected in the permanent mold. To remove effectively it is an important problem. The present invention desolved this problem so as to discharge under suction the shell sand remained in the sand injecting nozzle together with unhardened shell sand in the core while the permanent mold contacts with sand injecting means.

What is claimed is:

1. A hollow core molding device for use in a shell mold, characterized in that said device comprises:

a sand container having at least one sand injecting pipe;

a movable suction member having at least one sand injecting pipe and a downwardly opened suction chamber, said movable suction member being movable between a first position for communicating said sand injecting pipes with a sand injecting nozzle connected to a core mold for injecting shell sand into a cavity within the core mold and a second position for communicating said downwardly opened suction chamber with an upwardly opened suction chamber in a fixed suction member, said upwardly opened suction chamber communicated with an external vacuum means, and said fixed suction member including said sand injecting nozzle;

such that said shell sand is injected into the core mold when the sand injecting pipe provided in the sand container, the sand injecting pipe disposed in the movable suction member and the sand injecting nozzle disposed in the fixed suction member are in communication with each other, and unhardened shell sand is removed from said cavity by suction after molding a core when said movable suction member is shifted to thereby communicate the sand injecting pipe of the fixed suction member with said downwardly opened suction chamber of the movable suction member and the upwardly opened suction chamber of the fixed suction member.

2. A hollow core molding device for use in a shell mold, characterized in that a fixed suction member is provided in a sand container, said fixed suction member having a suction chamber communicated with an external vacuum means, and a sand injecting pipe having one closed end, a passage at an intermediate portion on one side of said pipe and a flanged portion at the other end of said pipe, said sand injecting pipe having a spring interposed between the flange and the fixed suction member and said sand injecting pipe movably extending through said fixed suction member into said sand container such that said passage is communicated with said sand container and wherein said spring acting against said flange moves said pipe away from said sand container such that said passage is communicated with said suction chamber.

3. A molding apparatus comprising:

core mold means including at least one cavity for molding, container means for containing sand, said container means including at least one injection means for injecting sand into said cavity, wherein said injection means includes a pipe extending from the interior to the exterior of said container means, vacuum suction means for removing excess unhardened sand from said cavity after molding, and means for selectively communicating said cavity with one of said container means or said vacuum suction means through at least a portion of said injection means, such that said cavity is injected with sand by being in communication with said container means, and said cavity is discharged of said excess unhardened sand by being in communication with said vacuum suction means, wherein said selective communicating means includes a movable member interposed between said container means and said core mold means, and a fixed member interposed between said movable member and said core mold means, said movable member including an aperture extending therethrough and a downwardly opened chamber separated from said aperture, said fixed member including an aperture extending therethrough to an injection nozzle for coupling to said cavity and an upwardly opened chamber separated from said aperture, said upwardly opened chamber communicating with said vacuum suction means, said movable member being relatively movable with respect to said container means and said fixed member between a first position wherein said pipe, said apertures and said nozzle are aligned for injecting sand into said cavity and a second position wherein said nozzle, said aperture in said fixed member and said downwardly opened chamber in said movable member are in communication with said upwardly opened chamber in said fixed member for discharging said excess unhardened sand from said cavity.

4. A molding apparatus according to claim 3, wherein said vacuum suction means includes an external vacuum source communicating with said upwardly opened chamber of said fixed member.

5. A molding apparatus comprising:

core mold means including at least one cavity for molding, container means for containing sand, said container means including at least one injection means for injecting sand into said cavity, vacuum suction means for removing excess unhardened sand from said cavity after molding, and means for selectively communicating said cavity with one of said container means or said vacuum suction means through at least a portion of said injection means, such that said cavity is injected with sand by being in communication with said container means, and said cavity is discharged of said excess unhardened sand by being in communication with said vacuum suction means, wherein said selective communicating means includes an extended tubular member including a closed end, an opened end, a flange about said opened end and an intermediate aperture in communication with said opened end between said closed and opened ends, said closed end being inserted in said container means and said opened end being arranged to be in communication with said cavity, said selective communicating means further including a spring member acting on said flange to maintain said intermediate aperture in communication with said vacuum suction means, and wherein said tubular member is arranged to be movable against the action of said spring upon coupling said opened end with said cavity such that said intermediate aperture is moved into said container means to communicate said container means and said cavity for injecting sand into said cavity through said tubular member, said tubular member being moved after molding to communicate said intermediate aperture with said vacuum suction means for discharging said excess unhardened sand.

* * * * *